US007549486B2

(12) United States Patent
Mashburn et al.

(10) Patent No.: US 7,549,486 B2
(45) Date of Patent: Jun. 23, 2009

(54) SCREEN APPARATUS AND METHOD

(76) Inventors: Benny Donald Mashburn, 103 Turn Row, Lafayette, LA (US) 70508; Douglas A. Beynon, 115 Countryside Dr., Youngsville, LA (US) 70592

( * ) Notice: Subject to any disclaimer, the term of this patent is extended or adjusted under 35 U.S.C. 154(b) by 0 days.

(21) Appl. No.: 11/998,794

(22) Filed: Nov. 30, 2007

(65) Prior Publication Data

US 2008/0087433 A1 Apr. 17, 2008

Related U.S. Application Data

(63) Continuation of application No. 11/091,304, filed on Mar. 28, 2005, now abandoned.

(51) Int. Cl.
*E21B 43/08* (2006.01)
*E21B 43/10* (2006.01)

(52) U.S. Cl. ..... 175/57; 175/314; 166/236

(58) Field of Classification Search ..... 175/309, 175/312, 314, 57; 166/380, 74, 205, 234, 166/236

See application file for complete search history.

(56) References Cited

U.S. PATENT DOCUMENTS 1,135,809 A 4/1915 Jones
3,302,722 A 2/1967 Madeley, Sr.
3,450,207 A 6/1969 Hirsch
3,515,210 A 6/1970 Perkins
4,495,073 A 1/1985 Beimgraben
5,377,750 A 1/1995 Arterbury et al.
5,762,137 A 6/1998 Ross et al.
6,155,342 A 12/2000 Oneal et al.
6,296,055 B1 10/2001 Taylor
6,571,869 B1 6/2003 Pluchek et al.
6,598,685 B1 7/2003 Mashburn
7,165,633 B2 1/2007 Hall et al.

*Primary Examiner*—David J Bagnell
*Assistant Examiner*—David Andrews
(74) *Attorney, Agent, or Firm*—Jones Walker

(57) ABSTRACT

A screen apparatus for use in a well bore. The apparatus comprises a latch; a first tubular disposed within the latch, the first tubular having an internal retrieving profile; a screen extending from the first tubular, and wherein the screen contains a first portion with a first outer diameter, and a second portion that extends to a second outer diameter, and wherein the first outer diameter is larger that than the second outer diameter. The apparatus further comprises a diverter device operatively attached to an inner portion of the first tubular, and wherein the diverter device contains a passage to divert the fluid to an outer portion of the screen. In one preferred embodiment, the screen comprises a series of longitudinal slots of progressively smaller length. Also, the screen may contain a stepped outer diameter portion and inner diameter portion. A method of cleaning debris is also included.

10 Claims, 15 Drawing Sheets

SCREEN APPARATUS AND METHOD

This application is a continuation application of my U.S. application Ser. No. 11/091,304, filed 28 Mar. 2005, now abandoned and entitled "SCREEN APPARATUS AND METHOD".

BACKGROUND OF THE INVENTION

This invention relates to a tool for filtering debris in a well bore. More particularly, but not by way of limitation, this invention relates to a tool for filtering debris that can be retrieved, cleaned and/or replaced, and run back into the well bore for resetting.

In the course of drilling oil and gas wells, drill bit cuttings are produced. The drill bit cuttings are contained within the well bore fluid. Some of the drill bit cuttings will be separated at the surface, but despite these efforts, cuttings remain. Also, other debris such as pipe scale from the work strings can also become entrained in the well bore fluid.

Modern day drilling bottom hole assemblies have, in addition to a bit device, drill motors, measurement while drilling tools, and other components. Debris can cause the bottom hole assemblies to malfunction. This is particularly true in the case of measurement while drilling tools. Prior art devices have been devised in order to separate the debris within the well bore fluid. For instance, U.S. Pat. No. 6,598,685, entitled "Drilling Fluid Screen And Method" and issued to applicant, discloses a screen that can be used to separate debris from the fluid and is incorporated herein by reference. While this design has been successful, it would be desirable for a screen that would allow placement closer to the bottom hole assembly. Prior art screens have limited ability to be retrieved and later put back into the work string.

Additionally, with the use of prior art screens, erosion or flow cutting is a larger problem in down hole screens than in the equivalent surface screens being run at the top drive. The down hole erosion is caused in part by the breaking up of the laminar flow in the drill string during the filtering action from the screen. The laminar flow problem is not as prevalent at the surface due to the fact that flow has not had a chance to "straighten out" (from running through the pumps, elbows, Kelly, etc.) before filtering.

Therefore, there is a need for a device that can be used to effectively filter debris from a well bore. There is also a need for a device that can be retrieved from the well bore, and later run back into the work string and re-set within the work string for filtering. There is also a need to prevent down hole erosion of the screen apparatus. These and many other needs will become apparent from a reading of the following description.

SUMMARY OF THE INVENTION

An apparatus for filtering debris within a well bore is disclosed. The apparatus comprises a latching means and a first tubular member disposed within the latching means, and wherein the first tubular member contains an internal retrieving profile. A screen extends from the first tubular member and a diverter device is operatively attached to an inner portion of the first tubular member, and wherein the diverter device contains a passage to divert the fluid to an outer portion of the screen.

The apparatus may further comprise a second tubular member concentrically disposed about the first tubular member, a third tubular member attached to the diverter device and concentrically disposed within the second tubular so that an annulus is created between the screen and the third tubular member and wherein the debris collects within the annulus.

In one preferred embodiment, the latching means comprises a plurality of protuberances and a groove with a shoulder contained on the first tubular member and wherein the protuberance engages the shoulder. The second tubular may contain a second shoulder and wherein the latching means contains a cooperating shoulder abutting the second shoulder.

The second tubular member, in one preferred embodiment, is connected to a work string within the well bore. The work string has a first end that may be connected to a drill bit device.

In one preferred embodiment, the apparatus may further comprise a pulling tool having a latching dog that is configured to engage the internal retrieving profile, the pulling tool being connected to a wire line within the well bore. The apparatus may further comprise a first seal means, configured on an outer portion of the first tubular member, for engaging with the inner portion of the latching means. Also, the apparatus may further contain second seal means, configured on an outer portion of the latching means, for engaging with an inner portion of the second tubular member.

In one preferred embodiment, the screen contains a first portion with a first outer diameter, and a second portion with a second outer diameter, and wherein the first outer diameter is larger that than the second outer diameter. Additionally, the screen may comprise a series of longitudinal slots and wherein the series of longitudinal slots decrease in length along the side of the screen; put another way, the series of longitudinal slots are of progressively smaller length. In yet another embodiment, the screen may comprise a plurality of longitudinal rods.

A method of cleaning debris from a fluid within a well bore is also disclosed. The method comprises providing a screen apparatus, with the screen apparatus comprising: a latch having at a first end a plurality of protuberances; a first tubular disposed within the latch, the first tubular containing a groove with a shoulder, and wherein the protuberances engages the shoulder; an internal retrieving profile disposed within an inner portion of the first tubular; a screen extending from the first tubular; a diverter operatively attached to the inner portion of the first tubular, and wherein the diverter contains a passage to divert the fluid to an outer portion of the screen; a second tubular, and wherein the first tubular is concentrically disposed within the second tubular; a third tubular attached to said diverter and concentrically disposed within said second tubular so that an annulus area is created between the screen and the third tubular member.

The method further includes flowing the fluid through the passage of the diverter, flowing the fluid into the annulus, then flowing the fluid through the screen, and collecting the debris within the annulus area. The flow of the fluid is terminated and a pulling tool on a wire line is run into the well bore. Next, the dogs of the pulling tool are engaged within the internal retrieving profile and the dogs are expanded so that the first tubular disengages with the latch, and the first tubular, the third tubular and the screen are pulled out of the well bore.

The method may include cleaning the debris from the annulus area at the surface. The operator can then lower the first tubular, the third tubular and the screen into the well bore via wire line. The protuberances of the latch are landed within the groove of the first tubular. The fluid is flowed through the passage of the diverter, then the fluid is flowed into the annulus, and then the fluid is flowed through the screen, and the debris is collected within the annulus area.

In another preferred embodiment, the screen contains a first portion with a first outer diameter, and a second portion with a second outer diameter, and wherein the first outer diameter is larger that than the second outer diameter; and the step of flowing the fluid through the screen includes creating a larger pressure drop about the first portion of the screen, than the pressure drop about the second portion of the screen. In yet another preferred embodiment, the screen may comprise a series of longitudinal slots that decrease in length along the side of the screen and wherein the step of flowing the fluid through the screen includes flowing the fluid through the longitudinal slots.

An advantage of the present invention is that the device is retrievable. Another advantage is that the screen, once retrieved, can be cleaned and/or replaced at the surface, and then can be run back into the well for further filtering. Still yet another feature is that the device in one preferred embodiment is placed in the bottom hole assembly just above the bit. Another advantage is that the screen can be used for filtering at the surface as well as down hole. Yet another advantage is that the use of graduated length slots along the screen that can be tuned to minimize flow erosion at the crossover point in the screen. The graduated length slots can spread the flow over a larger area on the screen thereby reducing the eroding effects of a single point cross-over.

Another advantage is the use of a non-slotted portion at the end of the screen which provides a cushion to further reduce the effects of transition during filtering. Still yet another advantage is the stepped screen tubing allows for a larger annulus for debris collection for a portion of the screen while providing the largest inner diameter possible out of the bottom of the screen (in the second portion of the screen), reducing the restriction and erosion.

A feature of the present invention includes an internal profile for retrievabilty. Another feature of the present invention is the use of a pulling tool to retrieve the device from the work string. Still yet another feature is that a wire line running tool can be used to reset the apparatus back into the work string.

DETAILED DESCRIPTION OF THE PREFERRED EMBODIMENTS

Figure 1A:
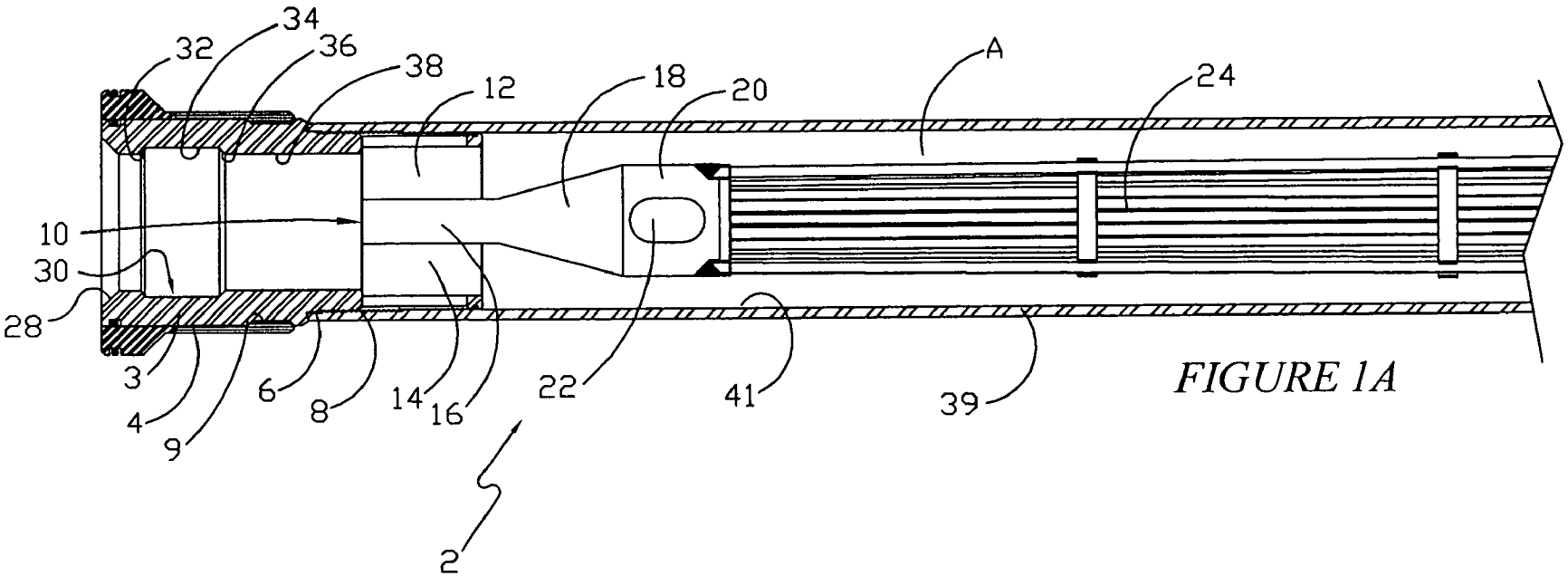
FIGS. 1A and 1B are cross-sectional views of the screen apparatus of the present invention.
Figure 1B:
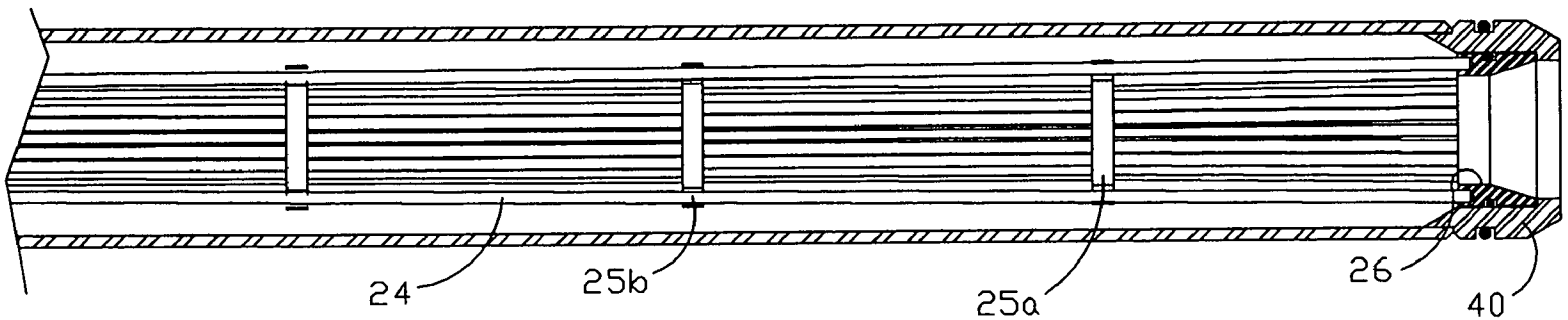

Referring now to FIGS. 1A and 1B, a cross-sectional view of the screen apparatus 2 of the present invention will now be described. The apparatus 2 includes a cylindrical member 3 that includes a first cylindrical surface 4 that extends to a second cylindrical surface 6, and wherein the second cylindrical surface 6 contains external thread means 8. The first cylindrical surface 4 contains a groove 9 therein. In one of the preferred embodiments, and as seen in FIG. 1, a diverter device 10 is integrally formed onto the cylindrical member 3.

The diverter device 10 contains a body having a plurality of passages 12, 14 formed there through for passage of the fluid, as will be more fully described later in the application. Also, the diverter device 10 has an integral centered portion 16 which extends to a radially expanding body 18 which in turn extends to the cylindrical body 20. The body 20 contains a by-pass 22 which communicates with the internal portion of the body. As seen in FIG. 1A, a plurality of longitudinal rods, seen generally at 24, extend from the body 20 and wherein the rods 24 form the screen in one embodiment. The rods 24 are attached to the body 20 using conventional means such as welding. As seen FIG. 1B, cylindrical bands 25*a*, 25*b* can be included as a means to hold the rods 24 together. The rods 24 are connected at a second end to the cylindrical member 26.

Returning to FIG. 1A, and extending radially inward from the cylindrical member 3 is the chamfered surface 28 which in turn extends to an inner portion and wherein the inner portion contains a retrieving profile 30, sometimes referred to as a fishing neck. The profile 30 contains a first shoulder 32, a first inner surface 34, second shoulder 36, which in turn extends to the second inner surface 38 and wherein the second inner surface 38 leads to the diverter device 10.

Also included in FIG. 1A is the debris tube, seen generally at 39. The debris tube 39 threadedly connects with the thread means 8 of the cylindrical member 3 at a first end and with the bottom sub 40, seen in FIG. 1B. Note that the bottom sub 40 and cylindrical member 26 are threadedly connected. Hence, as seen in FIG. 1A, an annulus area A is formed between the longitudinal rods 24 and the inner portion 41 of the debris tube. The annulus area A will trap debris in the filtering process, as will be more fully set out later in the application.

Figure 2:
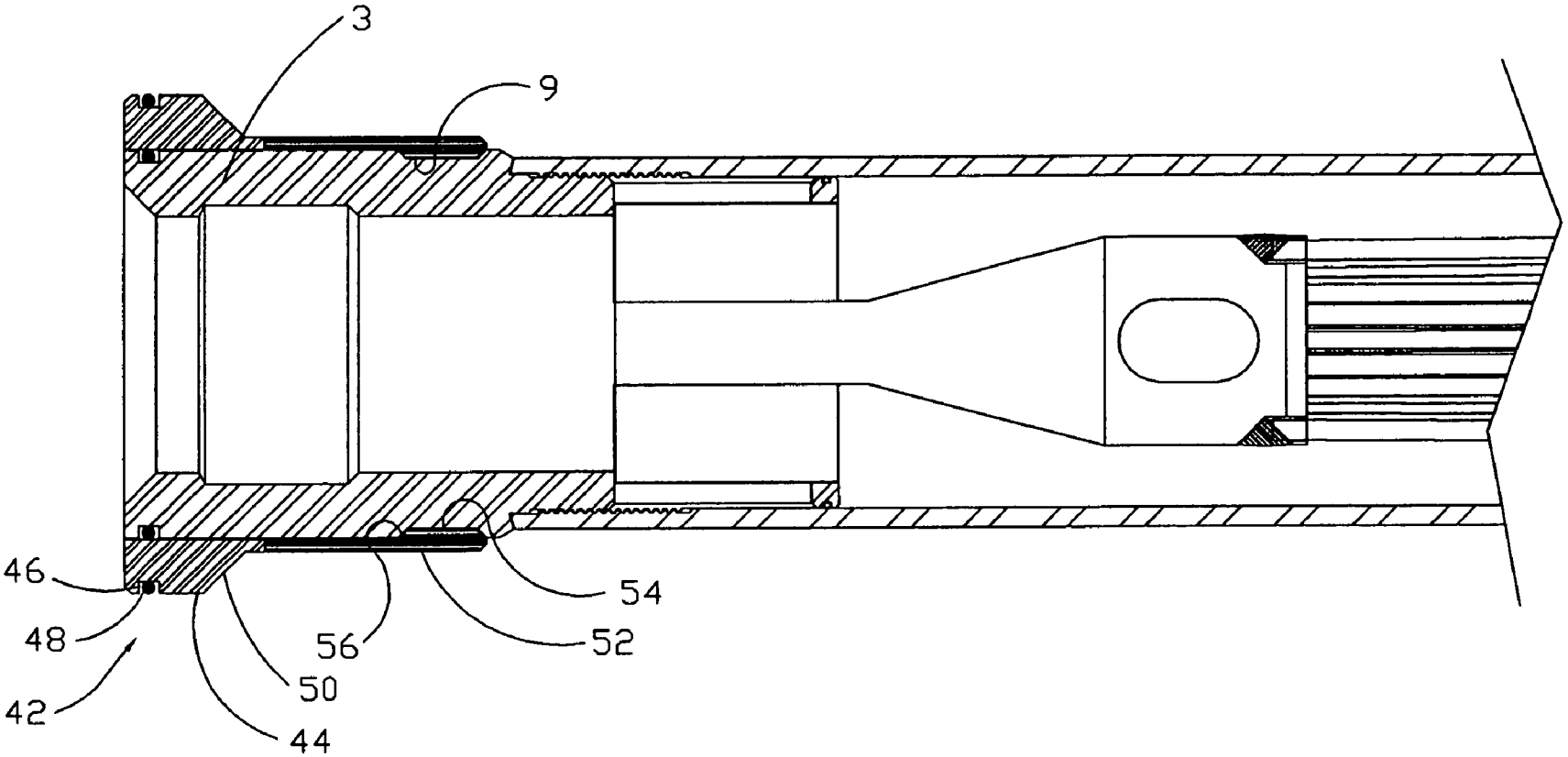
FIG. 2 is a cross-section view of the latch member of the present invention.

Referring now to FIG. 2, a cross-section view of the latch member 42 of the present invention that latches onto the cylindrical member 3 will now be described. It should be noted that like numbers appearing in the various figures refer to like components. The latch member 42 contains a first outer cylindrical surface 44 that contains a groove 46 for placement of a seal means, such as o-ring 48. The surface 44 leads to the chamfered surface 50 that in turn leads to a plurality of fingers 52. The plurality of fingers are sometimes referred to as dogs. The fingers 52 will cooperate with, and fit into, the groove 9 of the first cylindrical surface 4. More specifically, the fingers 52 contain a protuberance 54 that will fit into groove 9 and the protuberance 54 contains a shoulder 56 on the inner portion of the latch member 42 that will engage with the groove 9 and more specifically with a shoulder of groove 9.

Figure 3A:
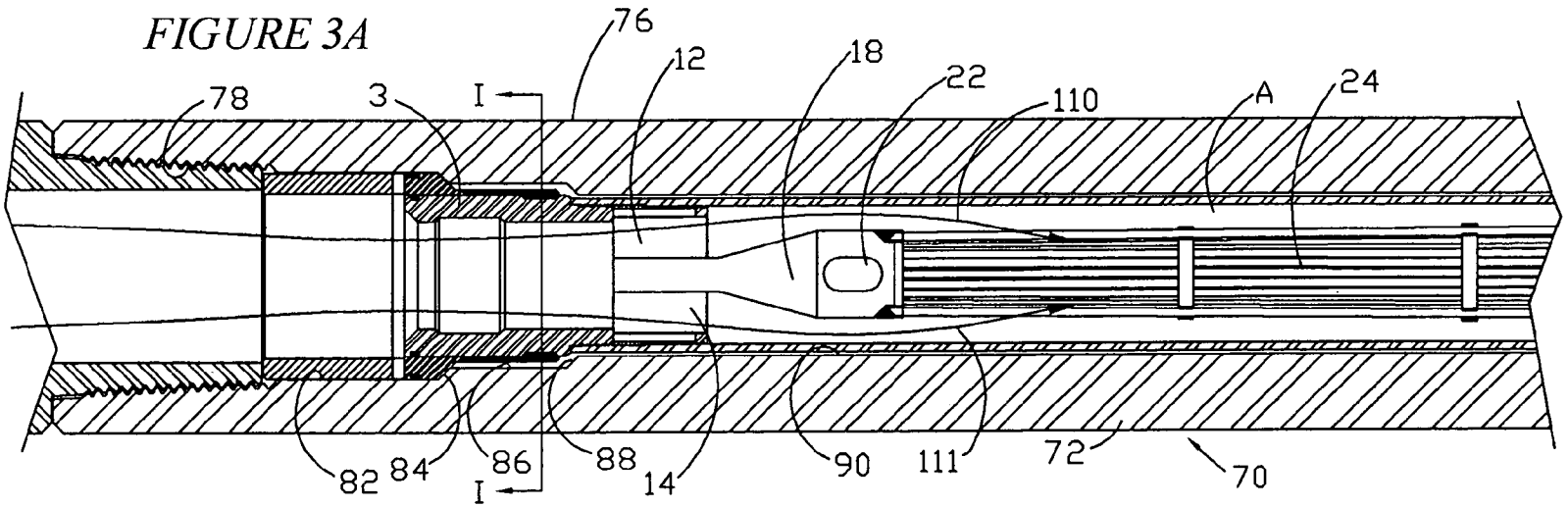
FIGS. 3A and 3B are cross-sectional views of the apparatus of FIGS. 1A, 1B and 2 within a carrier sub.
Figure 3B:
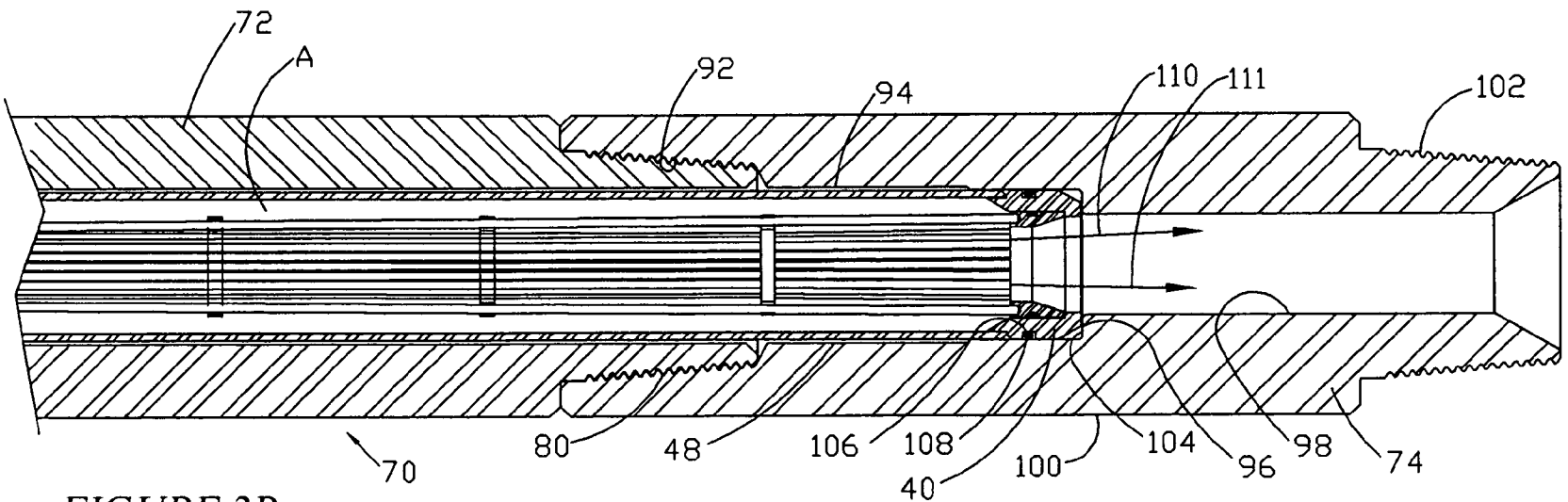

In FIGS. 3A and 3B, cross-sectional views of the apparatus 2 of FIGS. 1A, 1B and 2 within a carrier sub 70 will now be described. In one preferred embodiment shown in FIGS. 3A and 3B, carrier sub 70 comprises a first sub 72 and a second sub 74. The first sub 72 contains an outer cylindrical surface 76 that has at a first end internal thread means 78 and at a second end external thread means 80, seen in FIG. 3B. Returning to FIG. 3A, extending radially inward is the first inner surface 82 that continues to the chamfered surface 84 which in turn continues to the inner surface 86 which in turn continues to the chamfered surface 88. The chamfered surface 88 extends to the inner surface 90.

The second sub 74 is threadedly connected to the first sub 72 as seen in FIG. 3B. More specifically, the second sub 74 has internal thread means 92 that connect with the external thread means 80. The second sub 74 contains a first internal cylindrical surface 94 that extends to the shoulder 96, with a second internal cylindrical surface 98 extending therefrom. The second sub 74 contains an outer cylindrical surface 100 that extends to the external thread means 102.

The shoulder 96 will abut the bottom sub 40 and in particular the radial surface 104 of the bottom sub 40. Additionally, the bottom sub 40 has a groove 106 that contains an o-ring 108. The o-ring 108 will effect a seal. The flow of fluid through the apparatus is generally seen by the arrows labeled 110, 111. Hence, the flow of fluid will be down the internal portion of the cylindrical member 3, through passages 12, 14, about the body 18. The debris will become trapped in the annulus A, while the fluid will flow past the screen 24. The fluid flow will continue through the inner portion of the second sub 74 and into the work string, as will be well understood by those of ordinary skill in the art. If the screen becomes totally plugged, the fluid can pass through the by-pass 22 into the inner part of the screen 24.

Figure 4:
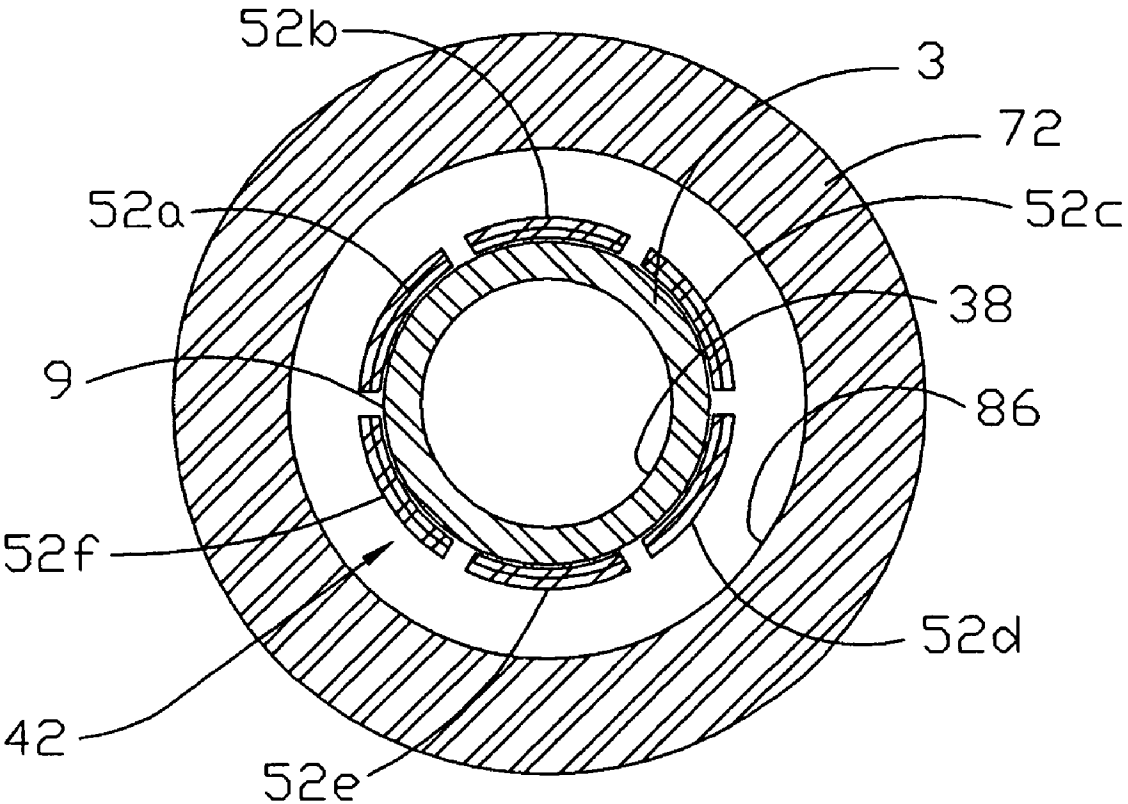
FIG. 4 is a cross-sectional view taken along line I-I in FIG. 3.

Referring now to FIG. 4, a cross-sectional view taken along line I-I in FIG. 3A will now be described. The plurality of fingers 52 of the latch member 42 are shown. More specifically, the fingers 52*a*, 52*b*, 52*c*, 52*d*, 52*e*, 52*f* are shown disposed about the cylindrical member 3 and in particular groove 9, and wherein the latch member is seated within the first sub 72. The second inner surface 38 of cylindrical member 3 is shown, along with inner surface 86 of first sub 72.

Figure 5:
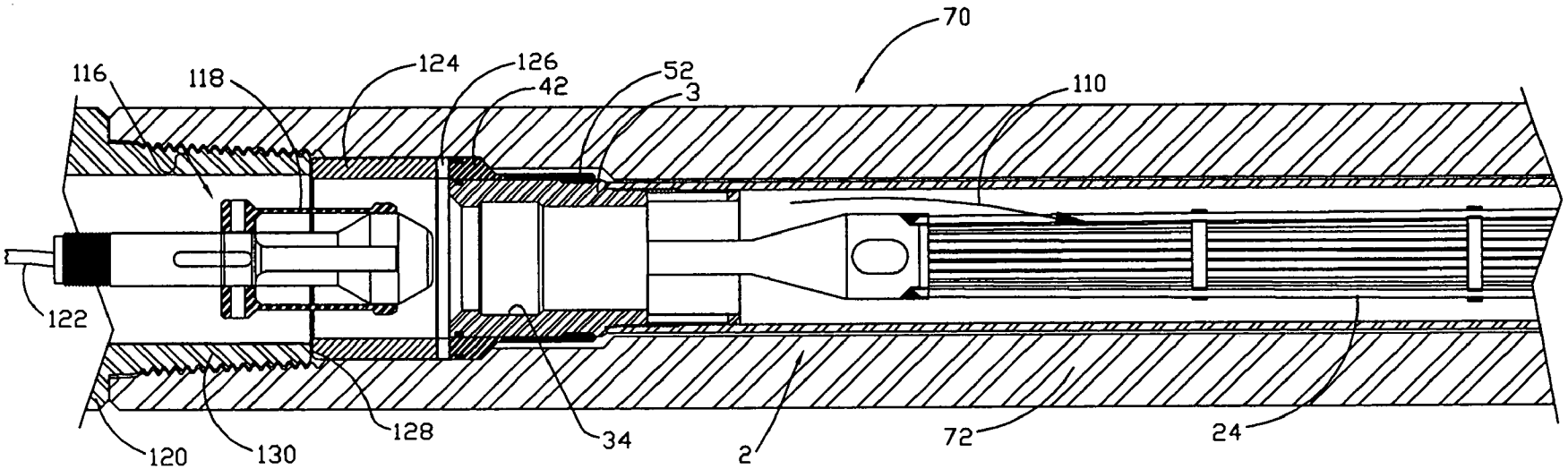
FIG. 5 is the apparatus in the carrier sub seen in FIG. 3 with a pulling tool positioned therein.

FIG. 5 depicts the apparatus 2 within carrier sub 70 (as seen in FIG. 3) with a pulling tool 116 positioned therein. The pulling tool 116 is commercially available from Weatherford Inc. under the name GS Style Pulling Tool. The pulling tool 116 will contain dog members 118. The pulling tool 116 is run into the work string 120 via a wire line 122. It should be noted that the pulling tool 116 may also be run on other types of means such as coiled tubing and snubbing pipe. FIG. 5 also depicts a first cylindrical sub 124 that abuts a crush ring 126, which may be an elastomeric ring in one preferred embodiment. Note that the radial end 128 of the first sub 124 abuts the pin end 130 of the work string 120. In this way, when the work string 120 is made up to the apparatus 2, the latch member 42 is held into place. The is purpose of ring 126 is to prevent over-torquing due to the length tolerances of the work string 120, carrier sub 70, and other components.

Figure 6:
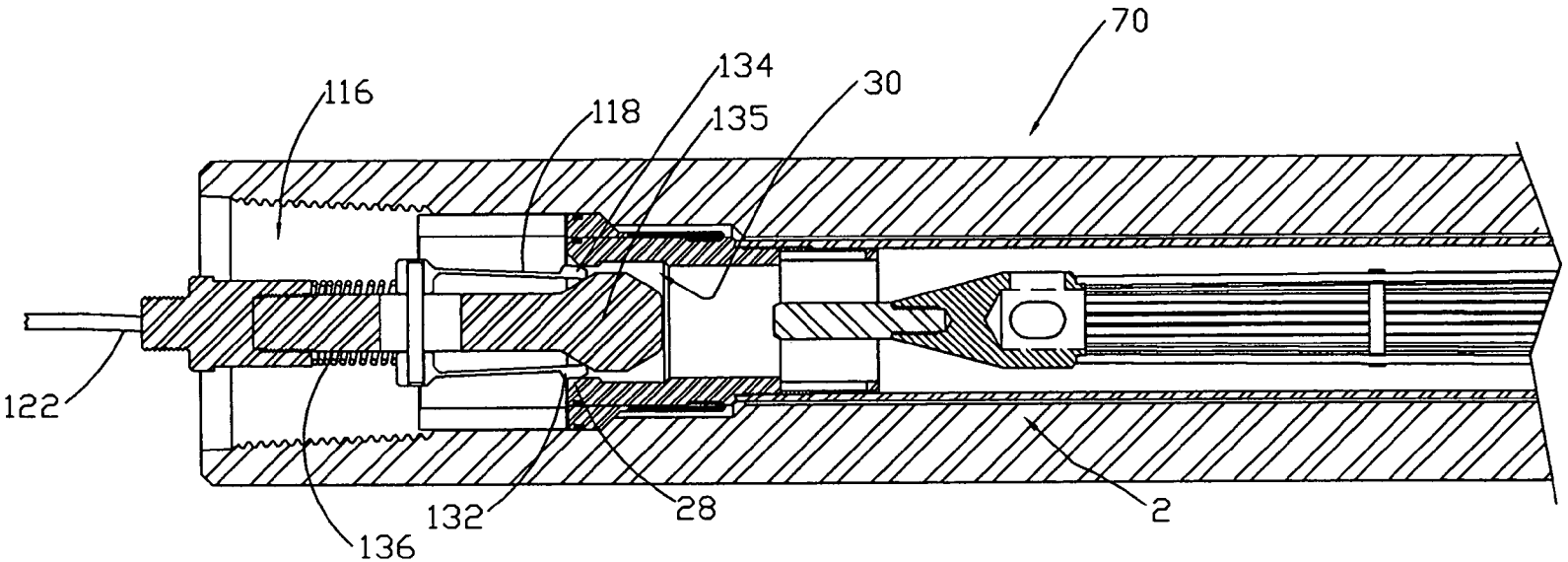
FIG. 6 is a sequential view of the apparatus and pulling tool seen in FIG. 5, with the pulling tool being positioned within the apparatus.

Referring now to FIG. 6, a sequential view of the pulling tool 116 being positioned within the carrier sub 70 (seen in FIG. 5) will now be described. The dog members 118 contain the protuberances 132, 134 and wherein the protuberances 132, 134 are supported by the expanded mandrel area 135. As is well understood by those of ordinary skill in the art, as the pulling tool 116 is lowered, the protuberances 132, 134 will come into contact with the top of the cylindrical member 3, and more specifically, on the chamfered surface 28. As the pulling tool 116 is continued to be lowered, the spring 136 will collapse due to the weight of the assembly pushing against it. The dog members 118, and in particular the protuberances 132, 134 will be able to contract since the protuberances 132, 134 are no longer supported by the expanded mandrel area 135, and the dogs may also bend inward. The dog members 118 can be lowered into the internal retrieving profile 30.

Figure 7:
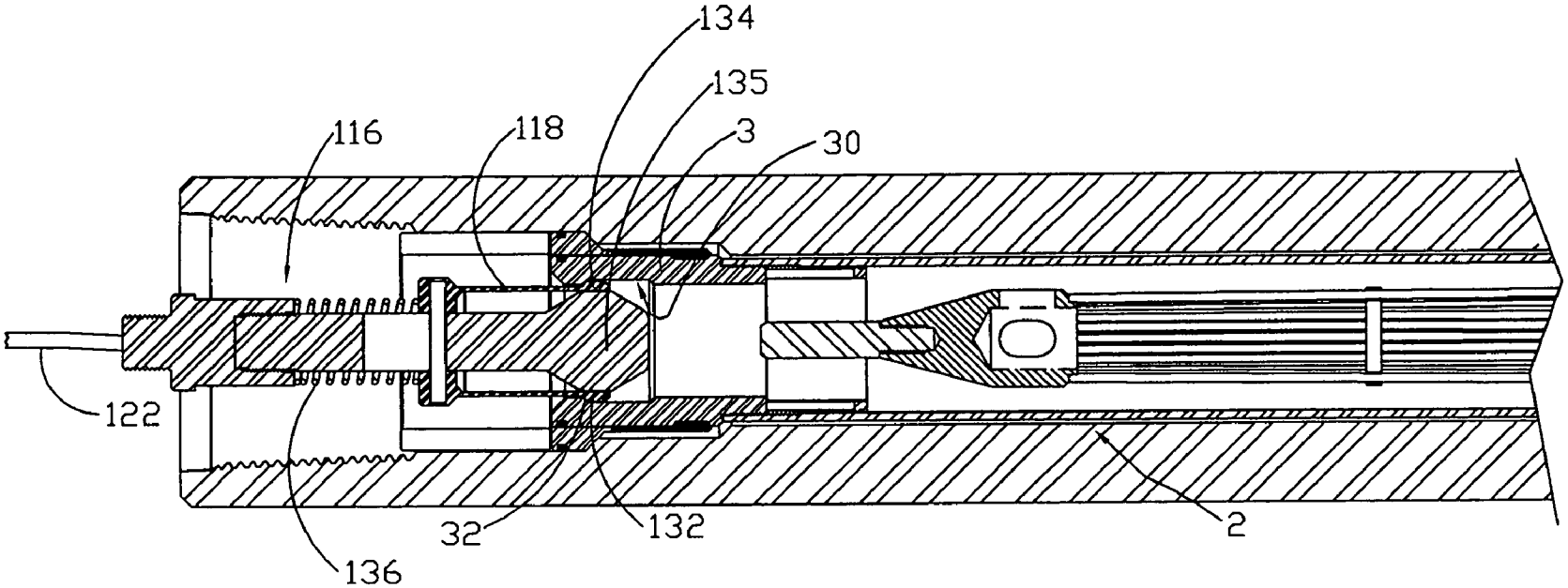
FIG. 7 is a sequential view of the apparatus and pulling tool seen in FIG. 6, with the pulling tool engaging the apparatus.

Once the dog members 118 are lowered into the retrieving profile 30, then the operator exerts an upward pull on the wire line 122 in order to engage the retrieving profile 30. FIG. 7 is a sequential view of the apparatus 2 and pulling tool 116 seen in FIG. 6, with the pulling tool 116 engaging the retrieving profile 30 apparatus 2. The expanded mandrel area 135 has now been allowed to expand the dog members 118 outwardly which in turn cause the protuberances 132, 134 to engage shoulder 32, as is well understood by those of ordinary skill in the art.

Figure 8:
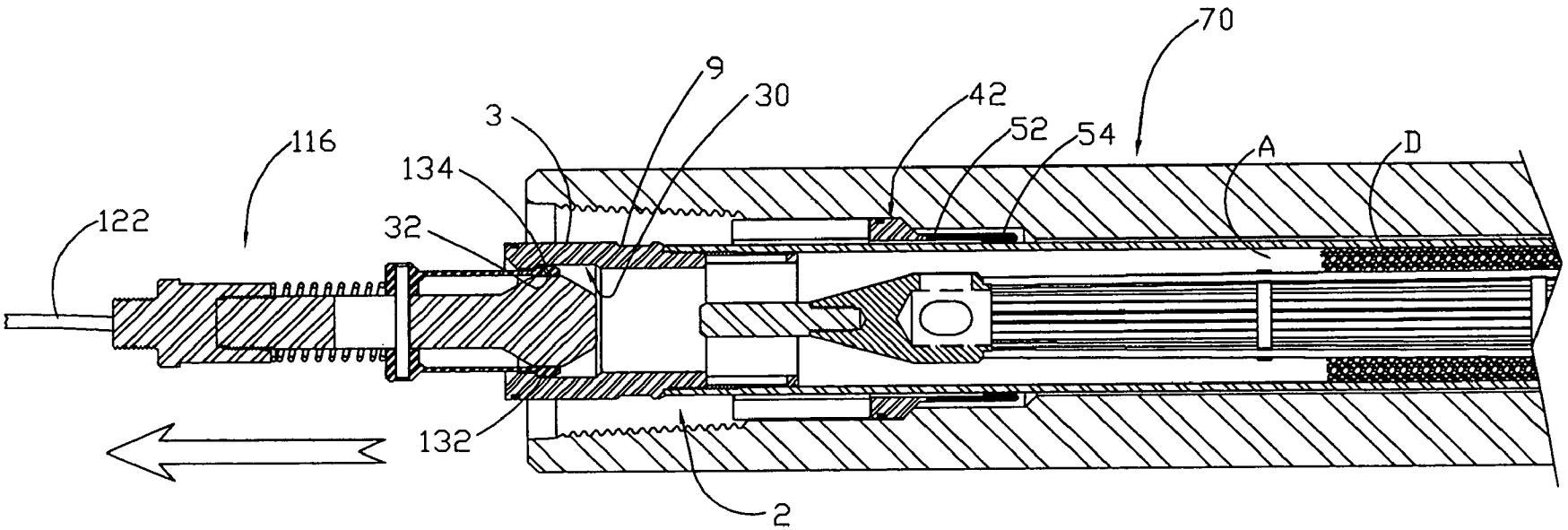
FIG. 8 is a sequential view of the apparatus and pulling tool seen in FIG. 7, with the apparatus being retrieved from the carrier sub.

FIG. 8 is a sequential view of the apparatus 2 and pulling tool 116 seen in FIG. 7, with the apparatus 2 being retrieved from the carrier sub 70. The pulling tool 116, and in particular the protuberances 132, 134, has engaged the internal retrieving profile 30. A pulling force on the pulling tool 116 via the wire line 122 is exerted and wherein this force will cause the fingers 52 of the latch member 42, and in particular the protuberances 54 to engage the groove 9 of the cylindrical member 3. Continued pulling will cause the fingers 52 to expand, thereby allowing groove 9 to slip past and freeing the apparatus 2 from the latch member 42 i.e. cylindrical member 3 becomes unlatched to the latch member 42 as seen in FIG. 8. The apparatus 2 can then be pulled from the work string 120 and brought to the surface. Once at the surface, the debris D that collected within the annulus A can be taken out. Other maintenance work can be preformed on the apparatus 2. The apparatus 2 can then be run back into the work string to again be seated within the carrier sub 70.

Figure 9:
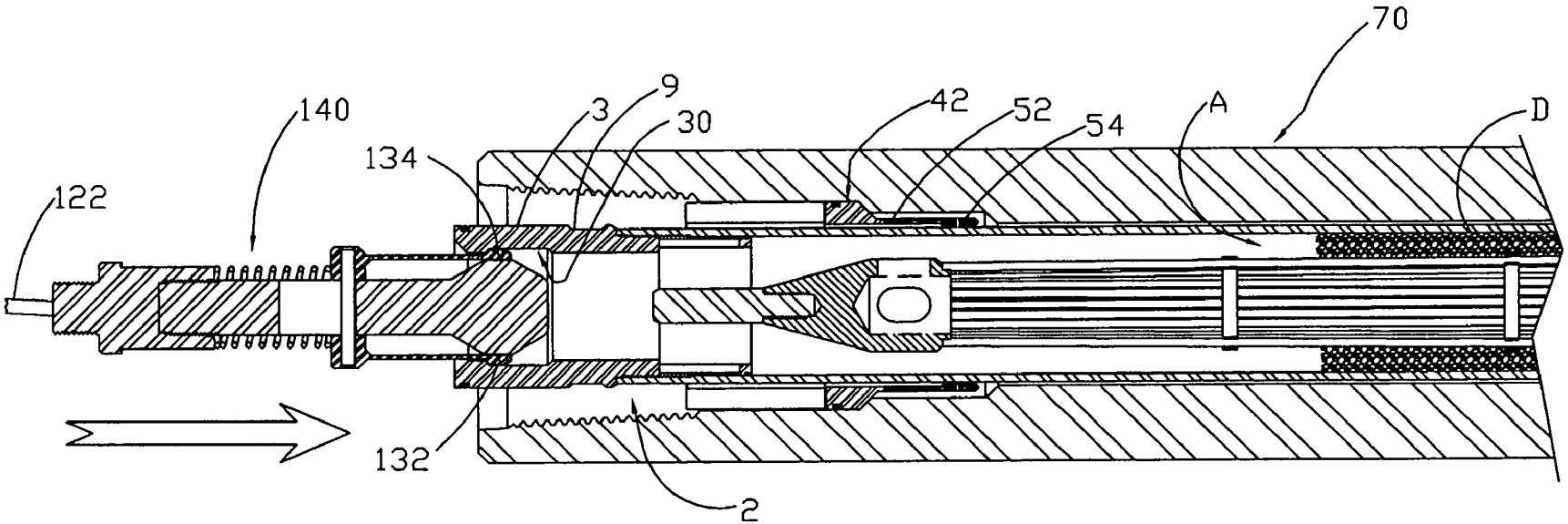
FIG. 9 depicts the apparatus being run into a work string on a running tool.
Figure 10:
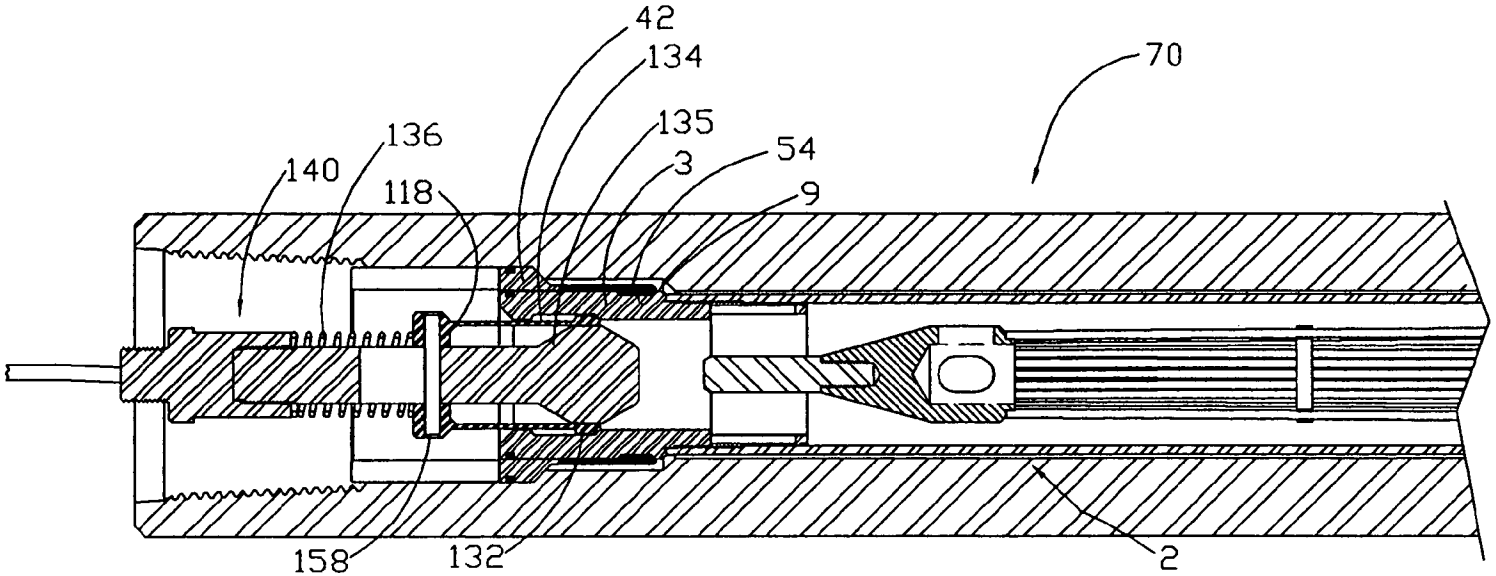
FIG. 10 is a sequential view of the apparatus of FIG. 9 being latched into place within the carrier sub.
Figure 11:
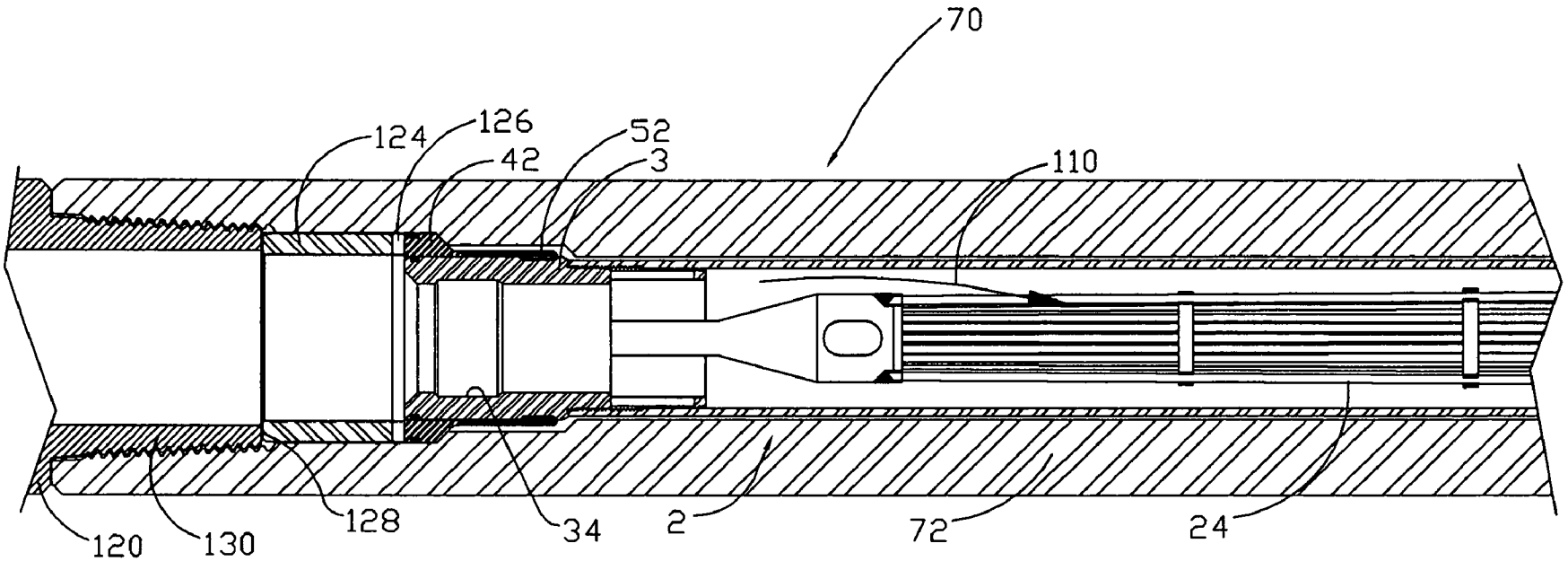
FIG. 11 is a sequential view of the apparatus of FIG. 10 having been set within the carrier sub.

The apparatus 2 can be run back into a work string on a running tool. FIG. 9 depicts the running tool 140 attached to the apparatus 2 being lowered into place within the carrier sub 70 in order to latch the apparatus 2 into the latch member 42. The running tool 140 is commercially available from Weatherford Inc. under the name GS Style Running Tool. Referring to FIG. 10, a sequential view of the apparatus 2 of FIG. 9 is being latched into place within the carrier sub 70. Hence, as the apparatus 2 is being placed into the carrier sub 70, the fingers 52 of the latch member 42 will expand radially outward thereby allowing the placement of the apparatus 2. Once the protuberances 54 pass the groove 9, the protuberances expand into the groove 9 thereby allowing the expansion and setting of the apparatus 2 within the carrier sub 70. FIG. 10 shows the protuberances 54 expanded into the groove 9 so that the apparatus 2 is set within the carrier sub 70. The running tool 140 can then be sheared off via shear pin 158, and the running tool 140 is removed from the work string. Fluid flow can then continue and wherein the fluid will be again filtered as previously noted. FIG. 11 depicts a sequential view of the apparatus 2 of FIG. 10 having been set within the carrier sub 70.

Figure 12A:
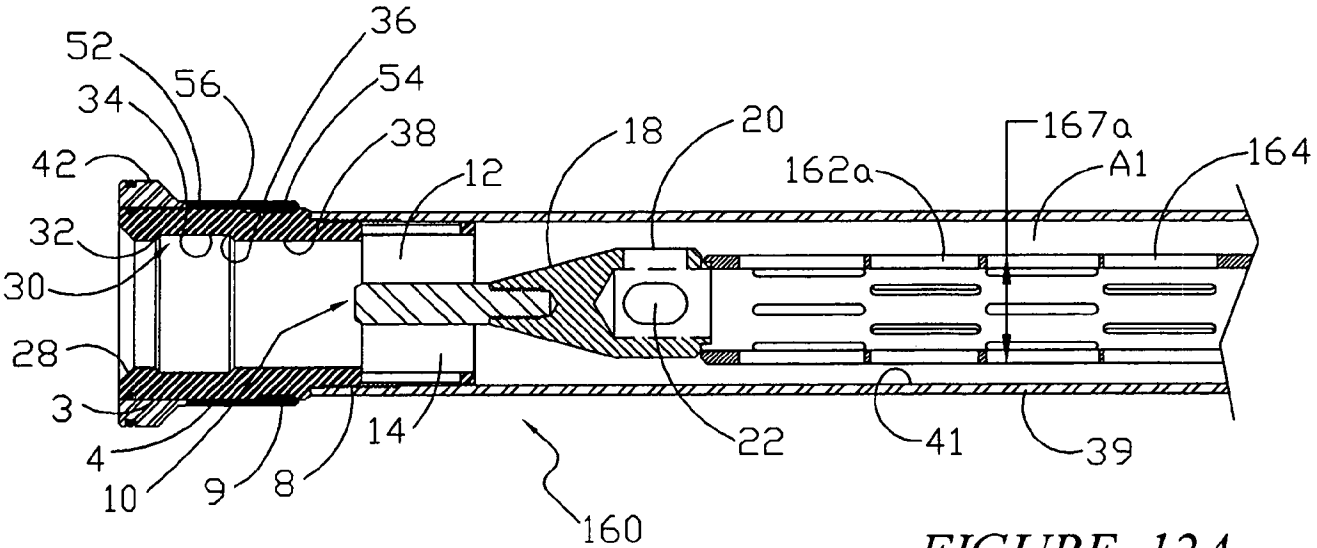
FIGS. 12A and 12B are cross-sectional views of a second embodiment of the screen apparatus of the present invention.
Figure 12B:
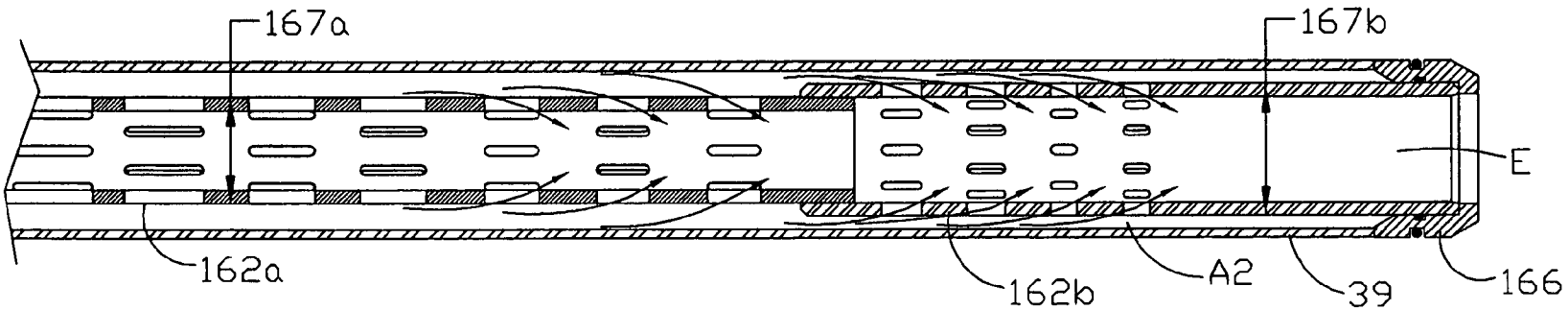

Referring now to FIGS. 12A and 12B, a cross-sectional view of a second screen apparatus embodiment, which is the most preferred embodiment of this application, will now be described. The apparatus 160 is similar to the apparatus 2 described earlier. This most preferred embodiment includes a stepped screen and a graduated slot length. It should be noted that like numbers appearing in the various figures refer to like components. As seen in FIG. 12A, the apparatus includes a cylindrical member 3 that includes the groove 9 therein. The diverter device 10 is integrally formed onto the cylindrical member 3.

The diverter device 10 contains the plurality of passages 12, 14 formed there through for passage of the fluid. The body 20 contains a by-pass 22 which communicates with the internal portion of the body when the screen becomes plugged. In the most preferred embodiment of FIGS. 12A and 12B, the stepped screen comprises a first cylindrical screen tube 162*a* and second cylindrical screen tube 162*b*, wherein the tubes 162*a*, 162*b* contain a plurality of longitudinal slots, seen generally at 164, that extend along the sides of tubes 162*a*, 162*b*. The length of the slots 164 decrease in individual length along the side of the cylindrical tubes 162*a*, 162*b*. In other words, the screen 162*a*, 162*b* comprise a series of longitudinal slots of progressively smaller length. As seen in FIG. 12B, the cylindrical tube 162*b* is connected at a second end to the cylindrical member 166. The tube 162*b* is of larger outer diameter 167*b* than the outer diameter 167*a* of the tube 162*a*. The larger outer diameter 167*b* reduces the effective area of the annulus A2 which in turn has an effect on the pressure drop of the fluid flow through screen i.e. creating a larger pressure drop in A2 during flow operations. The screen tube 162*a* has a smaller inner diameter than the screen tube 162*b*. The larger inner diameter of screen tube 162*b* allows a greater area for the fluid to exit the screen at exit E.

Returning to FIG. 12A, and extending radially inward from the cylindrical member 3 is the retrieving profile 30. Also included in FIG. 12A is the debris tube 39. The tubular 39 threadedly connects with the thread means 8 of the cylindrical member 3 at a first end and with the bottom sub 166. Note that the bottom sub 166 and debris tube 39 are threadedly connected. Hence, as seen in FIG. 12A, an annulus area A1 is formed between the screen and the inner portion 41 of the debris tube 39. In FIG. 12B, debris will be trapped in annulus A2, which is between the screen and debris tube 39. The effective area of annulus area A1 is greater than the effective area of annulus area A2. The annulus area A1 and A2 traps debris in the filtering process, as previously described.

Referring again to FIG. 12A, the latch member 42 is also shown. The latch member 42 contains the plurality of fingers 52. The fingers 52 contain a protuberance 54 that will fit into groove 9 and the protuberance 54 contains a shoulder 56 on the inner portion of the latch member 42 that will engage with the groove 9.

Figure 13A:
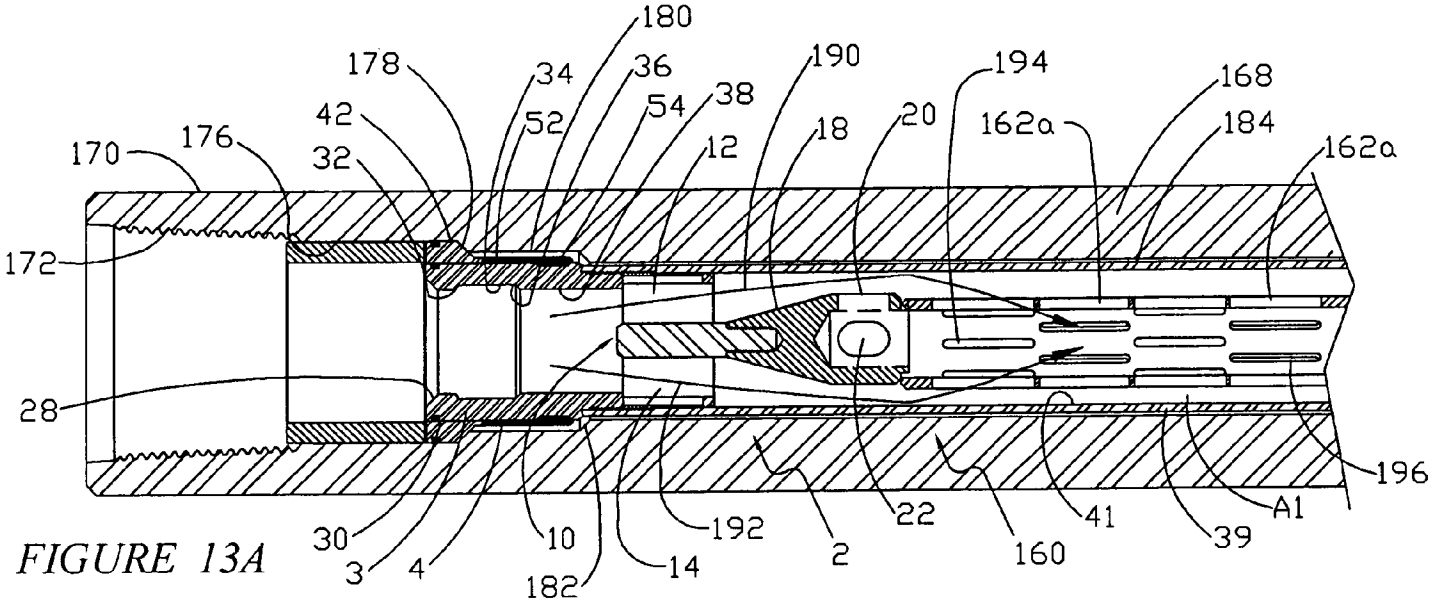
FIGS. 13A and 13B are cross-sectional views of the embodiment of FIG. 12 with the screen apparatus situated within a carrier sub.
Figure 13B:
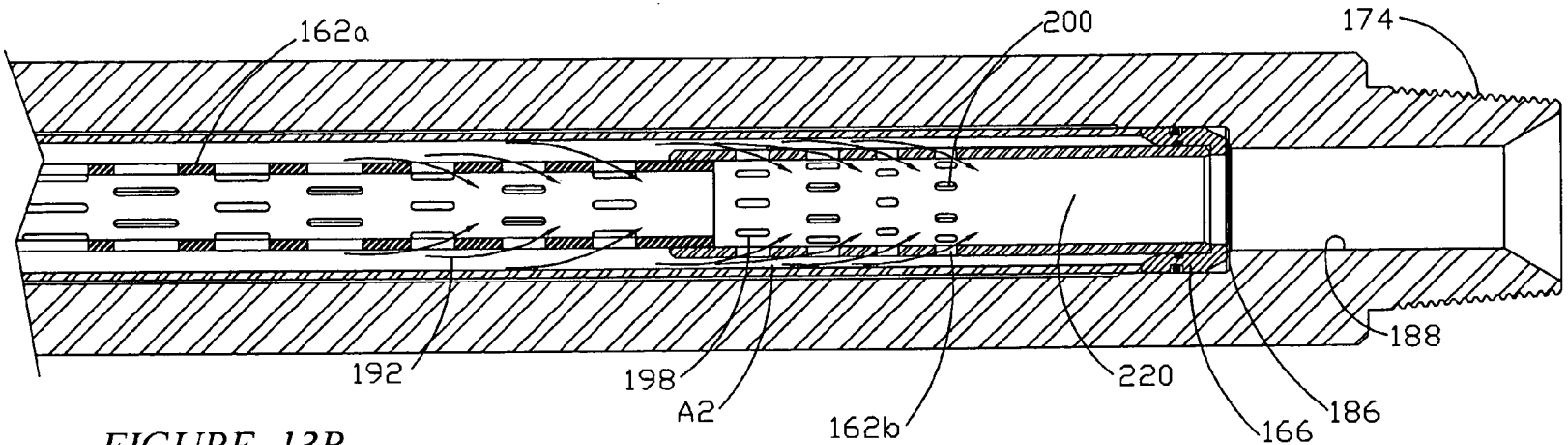

In FIGS. 13A and 13B, cross-sectional views of the apparatus 160 of FIGS. 12A, and 12B within the one-piece carrier sub 168 will now be described. In the most preferred embodiment shown in FIG. 13A, carrier sub 168 comprises an outer cylindrical surface 170 that has at a first end internal thread means 172 and at a second end external thread means 174, seen in FIG. 13B. Returning to FIG. 13A, extending radially inward is the first inner surface 176 that continues to the chamfered surface 178 which in turn continues to the inner surface 180 which in turn continues to the second chamfered surface 182. The chamfered surface 88 extends to the inner surface 184 that extends to shoulder 186 which in turn extends to internal surface 188 as seen in FIG. 13B.

The flow of fluid through the apparatus is generally seen by the arrows labeled 190 (seen in FIG. 13A) and 192 (seen in FIG. 13B). Hence, the flow of fluid will be down the internal portion of the cylindrical member 3, through passages 12, 14, about the conical body 18 and into the annulus A1 and A2. The debris will become trapped in the annulus A1 and A2, while the fluid will flow past the slot screen 162*a*, 162*b*. The fluid flow will continue through the inner portion of the carrier sub 168 and into the work string, as will be well understood by those of ordinary skill in the art.

As an example of the series of longitudinal slots of progressively smaller length, the length of slot 194 in FIG. 12A is 2 inches. Proceeding longitudinally downward, the next slot 196 has a length of 1.75 inches, while the next slot 198 has a length of 0.75 inches, and slot 200 has a length of 0.50 inches. In the most preferred embodiment, and as shown in FIGS. 13A and 13B, there are 16 rows of slots, with each row being a successively smaller length. In accordance with the teachings of the present invention, the tube 162*b* contains a blank section, seen generally at 220. The blank section 220 does not contain slots, therefore, fluid in annulus A2 can not enter through this blank section 220. The blank section 220 prevents the cutting out of this bottom section of tubing by providing a cushion for the fluid that is being circulated down the work string, and through the screen.

Figure 14A:
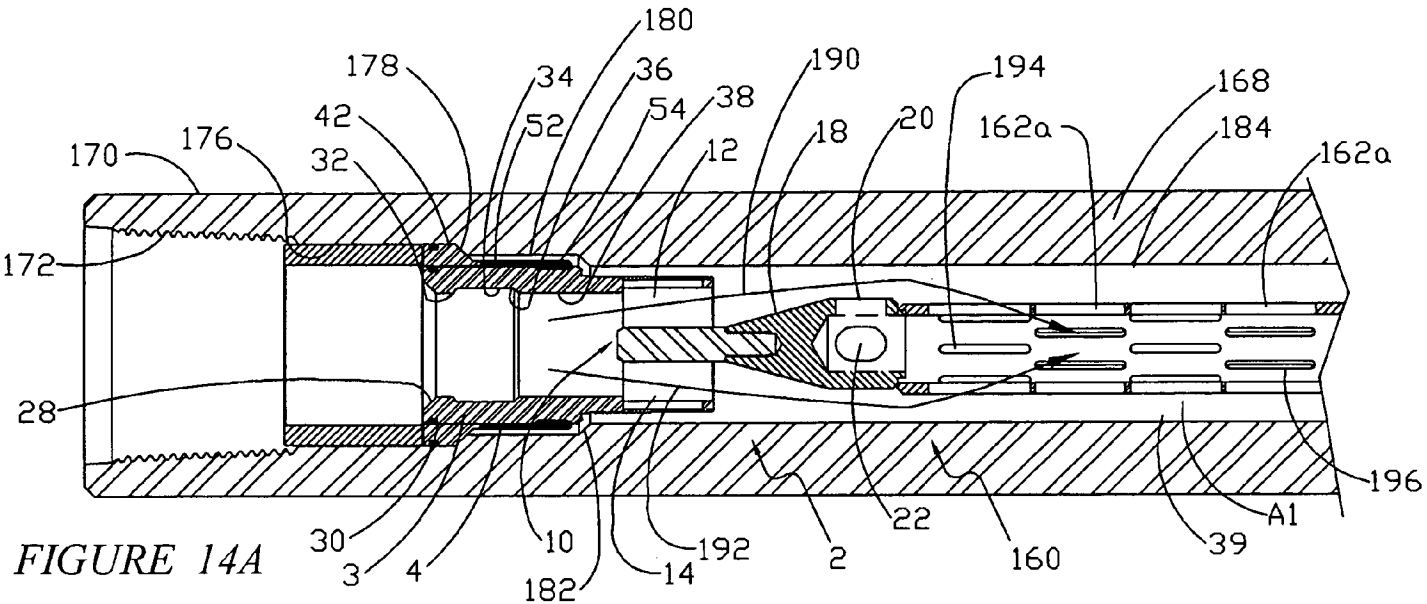
FIGS. 14A and 14B are cross-sectional views of a third embodiment of the screen apparatus of the present invention.
Figure 14B:
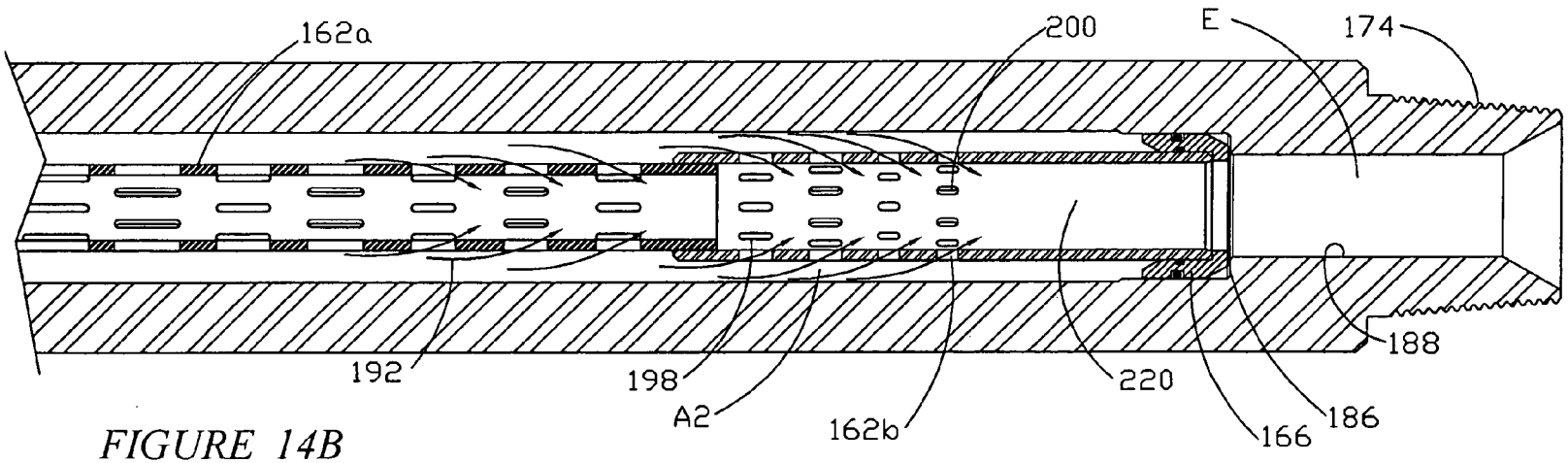

FIGS. 14A and 14B are a cross-sectional view of a third embodiment of the screen apparatus of the present invention. In this embodiment, the debris tube has been left out. All other aspects of the screen is the same as the screen seen in FIGS. 13A and 13B. FIGS. 14A and 14B also depict the flow arrows 190, 192. With this embodiment, there is more area for debris within the annulus A1 and annulus A2. This embodiment also contains the cylindrical member 166.

As noted earlier, erosion or flow cutting is a larger problem in down hole screens than the equivalent surface screens being run at the top drive. The down hole erosion is caused in part by the breaking up of the laminar flow in the drill string during the filtering action from the screen. The laminar flow problem is not as prevalent at the surface due to the fact that flow has not had a chance to "straighten out" (from running through the pumps, elbows, Kelly, etc.) before filtering. This invention addresses these problems in several ways including use of graduated slots seen in FIGS. 12A, 12B, 13A, 13B, 14A and 14B along the screen that can be tuned via length manipulation to minimize flow erosion at the crossover point in the screen. In other words, the length of the slots can be cut to meet specific flow characteristics. The graduated slots can spread the flow over a larger area on the screen reducing the eroding effects of a single point cross-over. The use of the non-slotted portion 220 at the end of the screen 162*b* provides a cushion to further reduce the effects of transition during filtering. The stepped screen tubing (162*a*, 162*b*) allows for a larger annulus for debris collection for a portion of the screen while providing the largest inner diameter possible out of the bottom E of the screen (in the second portion of the screen) for fluid output, reducing the restriction and erosion.

Figure 15:
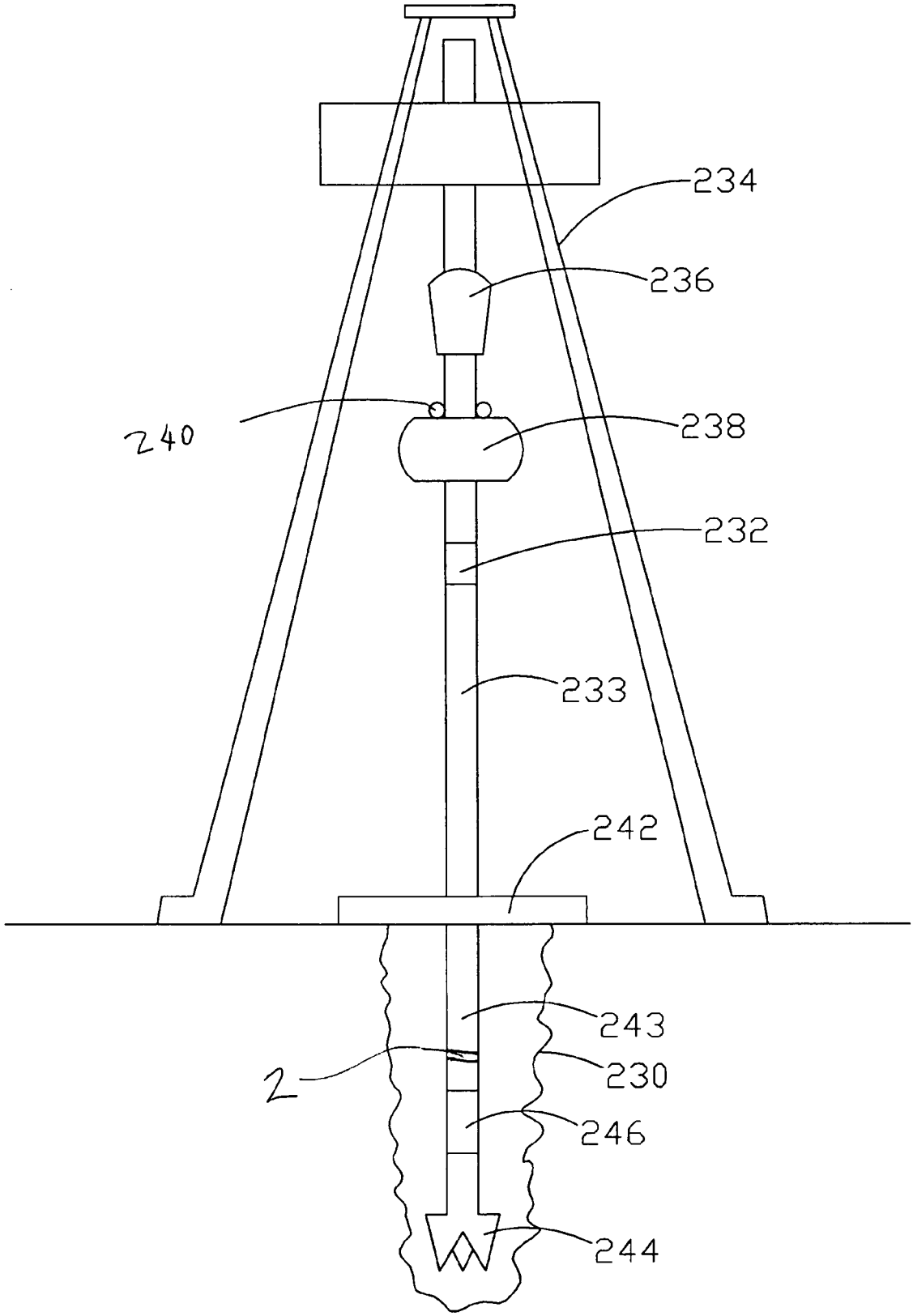
FIG. 15 is a schematic illustration of the apparatus of the present invention within a well bore.

Referring now to FIG. 15, a schematic illustration of the apparatus 2 of the present invention within a well bore 230 will now be described. It is also possible, according to the teachings of this invention, to place a screen apparatus 232 at the surface and in line with a Kelly 233. FIG. 15 depicts a drilling rig 234 with a block 236 that is operatively associated with the draw works, as understood by those of ordinary skill in the art. A swivel 238 is suspended from elevators 240, and wherein the Kelly 233 is attached to the swivel 238. The Kelly 233 will be attached to the rotary bushing 242, and wherein a rotary table will rotate the bushing 242 and Kelly 233. The screen apparatus 232 is seen connected in-line with the Kelly 233. A work string, such as a drilling string 243, extends into the well bore 230. The drill string 242 may have the bit 244 and MWD 246 operatively attached. Flow down the work string 242 is possible, and the fluid may be filtered in both apparatus 232 and apparatus 2 as previously described.

Changes and modifications in the specifically described embodiments can be carried out without departing from the scope of the invention which is intended to be limited only by the scope of the appended claims and any equivalents thereof.

We claim:

1. A down hole apparatus for use in a well bore, said wellbore having a fluid containing a debris therein, the apparatus comprising:

a carrier sub threadedly attached to a work string, said carrier sub having an inner portion containing a first chamfered surface;

a latch member with a plurality of fingers extending therefrom, each of said fingers having a protuberance, said latch member including a radial end surface and an angled end, wherein said first chamfered surface of said inner portion of said carrier sub cooperates with said angled end of said latch member, wherein said carrier sub is concentrically disposed about and engages said latch member;

a cylindrical sub disposed within said carrier sub, said cylindrical sub having a first end abutting a radial shoulder of the work string and a second end abutting said radial end surface of said latch member to hold said latch member in place;

a first tubular member disposed within said latch member, said first tubular member having an internal retrieving profile and a groove with a first shoulder, wherein said protuberance of each of said fingers engages said first shoulder of said groove of said first tubular member;

a diverter device operatively attached to an inner portion of said first tubular member, wherein said diverter device has an integral centered portion which extends to a radially expanding body;

a screen extending from said diverter device, wherein said integral centered portion of said diverter device contains a passage to divert the fluid to an outer portion of said screen, wherein the fluid flows from an outer portion of said integral centered portion and into an inner portion of said screen;

a debris tube attached to said first tubular member and concentrically disposed within said carrier sub and about said screen; and an annulus created between said screen and said debris tube, wherein the debris contained within the fluid collects within said annulus.

2. The apparatus of claim 1 wherein said carrier sub contains an internal second shoulder, wherein said latching means further contains a cooperating shoulder abutting said internal second shoulder of said carrier sub.

3. The apparatus of claim 2 wherein said work string has a first end connected to a drill bit device.

4. The apparatus of claim 3 further comprising:

a pulling tool having a latching dog that is configured to engage said internal retrieving profile of said first tubular member, said pulling tool being connected to a wire line within said well bore.

5. The apparatus of claim 4 further comprising:

a first seal means, configured on an outer portion of said first tubular member, for engaging with an inner portion of said latching means.

6. The apparatus of claim 5 further comprising:

a second seal means, configured on an outer portion of said latching means, for engaging with said inner portion of said carrier sub.

7. The apparatus of claim 6 wherein said screen comprises a plurality of longitudinal rods.

8. A method of cleaning debris from a fluid within a well bore comprising the steps of:

(a) providing a filtering apparatus within said well bore, said filtering apparatus comprising: a carrier sub threadedly attached to a work string, said carrier sub having an inner portion containing a first chamfered surface; a latch member with a plurality of fingers extending therefrom, each of said fingers having a protuberance, said latch member including a radial end surface and an angled end, wherein said first chamfered surface of said inner portion of said carrier sub cooperates with said angled end of said latch member, wherein said carrier sub is concentrically disposed about and engages said latch member; a cylindrical sub disposed within said carrier sub, said cylindrical sub having a first end abutting a radial shoulder of the work string and a second end abutting said radial end surface of said latch member to hold said latch member in place; a first tubular member disposed within said latch member, said first tubular member having an internal retrieving profile and a groove with a first shoulder, wherein said protuberance of each of said fingers engages said first shoulder of said groove of said first tubular member; a diverter device operatively attached to an inner portion of said first tubular member, wherein said diverter device has an integral centered portion which extends to a radially expanding body; a screen extending from said diverter device, wherein said integral centered portion of said diverter device contains a passage to divert the fluid to an outer portion of said screen, wherein the fluid flows from an outer portion of said integral centered portion and into an inner portion of said screen; a debris tube attached to said first tubular member and concentrically disposed within said carrier sub and about said screen; and an annulus created between said screen and said debris tube, wherein the debris contained within the fluid collects within said annulus;

(b) diverting the fluid from the inner portion of said first tubular member into the passage of the diverter device;

(c) flowing the fluid through said passage of the diverter device;

(d) flowing the fluid into the annulus;

(e) flowing the fluid from said outer portion of the screen through the screen and into said inner portion of the screen;

(f) collecting the debris within the annulus;

(g) terminating the flow of the fluid;

(h) running a pulling tool into said well bore on a wire line;

(i) engaging a set of dogs on the pulling tool within the internal retrieving profile of said first tubular member;

(j) expanding the dogs so that the latch member disengages the first tubular member; and (k) pulling an assembly out of the well bore comprising the first tubular member, the diverter device, the debris tube, and the screen, wherein said latch member remains in said carrier sub.

9. The method of claim 8 wherein the screen contains a first portion with a first outer diameter and a second portion with a second outer diameter, wherein the first outer diameter of said first portion of said screen is larger that than the second outer diameter of said second portion of said screen; and wherein the step of flowing the fluid through the screen includes creating a larger pressure drop in the annulus about the first portion of the screen than a pressure drop in the annulus about the second portion of the screen.

10. The method of claim 9 wherein the screen comprises a series of longitudinal slots on said outer portion that decrease in length and wherein the step of flowing the fluid through the screen includes flowing the fluid through the longitudinal slots.

* * * * *